US012781995B2

(12) United States Patent
Scherrer et al.

(10) Patent No.: US 12,781,995 B2
(45) Date of Patent: Nov. 3, 2026

(54) CLIMATE ISLAND

(71) Applicants: Jean-Marc Scherrer, Riedisheim (FR); Damien Lang, Strasbourg (FR)

(72) Inventors: Jean-Marc Scherrer, Riedisheim (FR); Damien Lang, Strasbourg (FR)

( * ) Notice: Subject to any disclaimer, the term of this patent is extended or adjusted under 35 U.S.C. 154(b) by 870 days.

(21) Appl. No.: 18/014,226

(22) PCT Filed: Jul. 2, 2021

(86) PCT No.: PCT/FR2021/051215

§ 371 (c)(1),
(2) Date: Jan. 3, 2023

(87) PCT Pub. No.: WO2022/003301

PCT Pub. Date: Jan. 6, 2022

(65) Prior Publication Data

US 2023/0296281 A1 Sep. 21, 2023

(30) Foreign Application Priority Data

Jul. 2, 2020 (FR) ..... 2006996

(51) Int. Cl.

| | |
|---|---|
| ***F24F 13/068*** | (2006.01) |
| ***F24F 11/79*** | (2018.01) |
| ***F24F 13/078*** | (2006.01) |
| ***F24F 13/14*** | (2006.01) |
| ***F24F 13/15*** | (2006.01) |

(52) U.S. Cl.

CPC ..... *F24F 13/068* (2013.01); *F24F 11/79* (2018.01); *F24F 13/078* (2013.01); *F24F 13/1426* (2013.01); *F24F 13/15* (2013.01); *F24F 2013/144* (2013.01); *F24F 2221/14* (2013.01); *F24F 2221/36* (2013.01)

(58) Field of Classification Search

CPC ..... F24F 13/068; F24F 11/79; F24F 13/15; F24F 13/06

USPC ..... 454/363

See application file for complete search history.

(56) References Cited

U.S. PATENT DOCUMENTS

| | | | | |
|---|---|---|---|---|
| 3,436,016 | A * | 4/1969 | Edwards | F24F 13/15 454/258 |
| 3,937,133 | A | 2/1976 | Bertin et al. | |
| 2003/0146291 | A1 | 8/2003 | Hunka | |
| 2004/0157543 | A1* | 8/2004 | Bertin | F24F 13/075 454/258 |

(Continued)

FOREIGN PATENT DOCUMENTS

| | | | | |
|---|---|---|---|---|
| CN | 108826631 | A * | 11/2018 | F24F 13/06 |
| DE | 29 10 433 | A1 | 10/1979 | |
| EP | 2 942 579 | B1 | 9/2019 | |

(Continued)

OTHER PUBLICATIONS

Oct. 5, 2021 International Search Report issued in International Patent Application No. PCT/FR2021/051215.

(Continued)

*Primary Examiner* — Allen R. B. Schult
*Assistant Examiner* — William C Weinert
(74) *Attorney, Agent, or Firm* — Oliff PLC

(57) ABSTRACT

A modular island system for heating, cooling and ventilating buildings by radiation and thermal convection as well as for the acoustic treatment of premises.

14 Claims, 7 Drawing Sheets

B-B

(56) References Cited

U.S. PATENT DOCUMENTS

2020/0003450 A1 1/2020 Surminski et al.

FOREIGN PATENT DOCUMENTS

| | | | | |
|---|---|---|---|---|
| JP | H02-68445 | A | 3/1990 | |
| KR | 20-2019-0001867 | U | 7/2019 | |
| WO | WO-2005012806 | A1 * | 2/2005 | ..... F24F 11/88 |
| WO | 2018/037184 | A1 | 3/2018 | |

OTHER PUBLICATIONS

Sep. 15, 2022 International Preliminary Report on Patentability issued in International Patent Application No. PCT/FR2021/051215.

* cited by examiner

B-B

B-B

B-B

A–A

CLIMATE ISLAND

FIELD OF THE INVENTION

The present invention relates to a modular island system, for heating, cooling and ventilating buildings by radiation and thermal convection, and for acoustic treatment of rooms.

DISCUSSION OF THE STATE OF THE ART

Ceiling diffusers are known that take the form of gratings which blow the treated air (heated or cooled air and ventilation air) toward the room at a determined angle.

Some of them blow air horizontally to the ceiling which is suitable for cooling rooms (the cold air, denser than the ambient air, descends naturally toward the room) but very ineffective for heating (the hot air, less dense than the ambient air, stagnates in the upper part of the room, thus creating a layering phenomenon). Some of them blow the air at right angles to the ceiling which is suitable for the heating of the rooms (the hot air, less dense than the ambient air, needs to be blown downward to prevent it from stagnating in the upper part of the room and creating a layering effect) but is very uncomfortable for the cooling (the cold air, denser than the ambient air, drops at high speed toward the room, creating air current phenomena).

Some of them blow the air at a determined angle (for example 45°) with respect to the ceiling towards the room so as to be suitable for heating and cooling but the efficiency of the diffusion is not then optimal on either of the two modes, so the general comfort is thus very approximate.

Also known are the perforated ceilings or modules which use a perforation to blow the treated air toward the room at a very low speed. This technology is suitable in cooling mode but is very inefficient in heating mode. Indeed, the hot air, less dense than the ambient air, needs to be blown to a certain velocity so as to benefit from enough kinetic energy to reach the floor of the room and therefore avoid the layering phenomena.

Also known are ceiling cassettes, often installed in particular in office spaces or businesses, the latter are provided on their periphery with motorized diffusion fins which make it possible to adjust the air blowing angle toward the room. The drawback with these lies in the fact that the user has to adjust the diffusion angle daily dependent on the blown air temperature which, in practice, is very difficult to do.

It should also be noted that all the methods cited previously use air blowing, therefore a convection effect, to transmit 100% of the thermal power. Because of this, they require significant air flow rates (and therefore air velocities) as well as a blown air temperature that is fairly far removed from the internal ambient temperature of the room which will often generate thermal discomfort within the room.

Other known methods, such as radiating panels, use thermal radiation to diffuse 100% of the useful thermal power. The latter can take the form of modules with, for some, the possibility of treating the acoustics of the room via a perforated plate that is permeable to the thermal radiation in the lower part of the module and an acoustic insulation disposed inside the module. This method that uses only the thermal radiation as diffusion vector is provided with a very limited cooling power because of the risk of reaching the dew point on the surface of the panel and therefore the risk of the formation of condensation.

Also known are cold beams, this method using a heat exchanger which, when in contact with the ambient air, generates an induction and therefore a convectional air flow.

The low velocities of the air flow induced make it possible for this method to benefit from satisfactory performance but only in cooling mode.

Finally, also known is the Barrisol Clim® device described in the document WO 2018/037184 A1 (Jean-Marc Scherrer [FR]; Damien Lang [FR]).

This device, unlike in the methods previously cited, uses both convection and radiation to diffuse the thermal power. Very comfortable in heating mode and in cooling mode by virtue of parietal air diffusion (along the walls of the room), it avoids the air current effects and makes it possible to benefit from a very good uniformity of temperature within the volume of occupancy of the room. It does however need to be installed over all of the surface of the ceiling of the room being served, thus allowing reduced flexibility in buildings where the rooms may often be required to be redefined via changes of partitioning, such as, for example, office spaces.

Moreover, US 2020/003450 (A1) (Surminski David Mark [CA] et al) describes a laminar flow diffuser with incorporated lighting having a frame for supporting an air plenum and a lower housing. The air plenum receives conditioned air from a conditioned air source. The lower housing is fixed to the bottom of the plenum. An aperture plate damper installed under the upper plenum regulates the air flow from the plenum through the laminar flow diffuser. A transparent or translucent perforated diffuser face forms the output of the lower housing toward the room below. LED strips are positioned around the inner periphery of the lower housing. A perforated reflector panel is positioned below the aperture plate damper and above the LED strips to diffuse the light from the LED strips through the perforated diffuser face.

For its part, the aim of JP H02 68445 (A) (Diesel Kiki Co) is to eliminate a driving power supply, to reduce the number of parts and to make it possible to prevent motor driving noise, to be effectuated by a method in which a heat-sensitive part is formed by a hydrogen occlusion alloy, an actuator is actuated by pressurizing hydrogen. When a temperature of the blown air inside an air blowing duct is high, the hydrogen is discharged from a hydrogen occlusion alloy, such that a hydrogen pressure inside a pipe and an actuator is increased. The actuator, composed of bellows, is extended because of the increase in hydrogen pressure, a rod is displaced upward and each of the shutters is set to be directed downward. In turn, when the temperature of the blown air inside the duct is low, the hydrogen is absorbed into the hydrogen occlusion alloy, such that the hydraulic pressure inside the pipe or the actuator decreases and thus the actuator is retracted and the rod is displaced downward. Each of the shutters is disposed upward. At an intermediate temperature between a high temperature and a low temperature, an angle of each of the shutters is controlled linearly in response to a hydrogen absorption and discharging characteristic of the hydrogen occlusion alloy.

U.S. Pat. No. 3,937,133 A (Bertin Mannie et al) describes an output for conditioned air that has a plurality of interconnected modules establishing its lateral walls which support a closed bottom and by which the output is linked to a mounting frame. Each module has a support frame composed of upper and lower lateral elements and end elements, of an extrusion length providing an outer wall and a wall disposed on the inside. Means are provided for interconnecting the frames to one another vertically or laterally in the same plane or at right angles so as to provide air-tight joins.

Generally, so as to reconcile significant cooling power and good thermal comfort (absence of air currents and uniformity of temperature in the room), it is necessary to benefit from a device that allows thermal diffusion both by radiation and by convection (blowing air toward the room).

Regarding the power diffused by thermal convection, it is important to diffuse the cooling air parallel to the ceiling and at low velocity so as to avoid the air current effects.

The heating air must, for its part, be diffused toward the floor of the room and at a greater velocity so as to ensure that it has sufficient reach to avoid the layering effects.

Finally, and apart from the Barrisol Clim® device previously cited, but which does however have the drawback of having to be installed over all of the ceiling surface of the room, the diffusion systems use either thermal convection or thermal radiation as diffusion vector for the thermal power necessary to the heating and the cooling of the room, which does not allow them to reconcile significant cooling power and satisfactory thermal comfort.

BRIEF DESCRIPTION OF THE INVENTION

The present invention proposes mitigating these drawbacks by proposing a modulus system of islands for heating, cooling and ventilating premises (homes, apartments, buildings, factories, sport halls, schools, hospitals, etc.) while ensuring excellent thermal comfort (absence of air current and uniformity of temperatures in the volume of occupancy) in heating and in cooling; the modular system of islands not needing to be positioned against the vertical walls and thus allowing it to be fixed onto only a part of the surface of the ceiling.

One of the aims of the present invention is to propose a radiating and convective system that makes it possible to heat and/or cool a room with great efficiency, strong admissible thermal powers and excellent thermal comfort evolving a uniformity of temperatures and absence of air currents.

In particular, the invention relates to an automatic ceiling diffuser system of a room, said system being suitable for heating, cooling and ventilating said room by radiation and thermal convection, said system comprising at least one modular island intended to be attached to the ceiling of the room, said modular island comprising:

- a peripheral frame provided with at least one line for attachment of a diffuser element such as a taut fabric situated in its lower part opposite the ceiling; on one or more of its faces said peripheral frame comprises a slit for blowing air toward the room;
- a diffusion element such as a taut fabric, attached to the attachment line of the peripheral frame, visible from the room and forming the horizontal bottom face of said modular island;
- a cover forming the top face of the modular face facing the ceiling;
- an air blowing connection outlet fixed to the cover of the modular island and allowing the injection of treated air into the internal volume of the modular island;
- a channel of articulated baffles formed by an upper articulated baffle and a lower articulated baffle, fixed to the peripheral frame at the air blowing slit and making it possible to orient the blown air at an angle defined with respect to the ceiling varying from 0°, namely parallel to the ceiling when cold air is blown into the island, to a maximum of 70° when hot air is blown into the modular island;
- a thermostatic actuation means making it possible to actuate said channel of articulated baffles via an actuation means of the baffles such as an actuation rod and conferring on the channel a blowing angle dependent on the temperature of the treated air injected into the modular island, said thermostatic actuation means comprising a piston, the output stroke of which depends on the temperature of air in which said thermostatic actuation means is immersed;
- a return spring making it possible to exert a force opposite the stroke of the piston of said thermostatic actuation means and thus making it revert to its minimum stroke when cold air is blown into the modular island, characterized in that said channel of articulated baffles comprises an articulated means for maintaining parallelism positioned in said channel and linking the upper and lower articulated baffles to the articulation points B and C respectively, said upper and lower articulated baffles fixed to the peripheral at the articulation points A and D describing, with the articulation points B and C of said articulated means for maintaining parallelism, a parallelogram A-B-C-D imposing a parallelism on opposite sides.

The invention also proposes a modular island intended for heating, cooling and ventilating a room by radiation and thermal convection, said modular island being able to suspended from the ceiling of a room, this modular island comprising:

- a peripheral frame provided with at least one line for attachment of a diffusion element such as a taut fabric situated in its lower part opposite the ceiling; on one or more of its faces, said peripheral frame comprises a slit for blowing air toward the room;
- a diffusion element such as a taut fabric, attached to the attachment line of the peripheral frame, visible from the room and forming the horizontal bottom face of said modular island;
- a cover forming the top face of the modular island facing the ceiling;
- an air blowing connection outlet fixed to the cover of the modular island and allowing the injection of treated air into the internal volume of the modular island;
- a channel of articulated baffles formed by an upper articulated baffle and a lower articulated baffle, fixed to the peripheral frame at the air blowing slit and making it possible to orient the blown air at an angle defined with respect to the ceiling varying from 0°, namely parallel to the ceiling when the blown air is blown into the island, to a maximum of 70° when hot air is blown into the modular island;
- a thermostatic actuation means making it possible to actuate said channel of articulated baffles via an actuation means of the baffles such as an actuation rod and conferring on the channel a blowing angle dependent on the temperature of the treated air injected into the modular island, said thermostatic actuation means comprising a piston, the output stroke of which depends on the temperature of air in which said thermostatic actuation means is immersed;
- a return spring making it possible to exert a force opposite the stroke of the piston of said thermostatic actuation means and thus make it revert to its minimal stroke when cold air is blown into the modular island, characterized in that said channel of articulated baffles comprises an articulated means for maintaining parallelism positioned in said channel and linking upper and lower articulated baffles to the articulation points B and C respectively, said upper and lower articulated baffles fixed to the peripheral frame at the articulation points A and D describing, with the articulation points B and C of said articulated means for maintaining parallelism, a parallelogram A-B-C-D imposing a parallelism on its opposite sides.

Other unexpected advantages of the composition according to the invention will become apparent on reading the detailed description and of exemplary embodiments of the invention.

BRIEF DESCRIPTION OF THE FIGURES

Examples of implementation of the invention are indicated in the description illustrated by the attached figures in which.

DETAILED DESCRIPTION OF THE INVENTION

Figure 1:
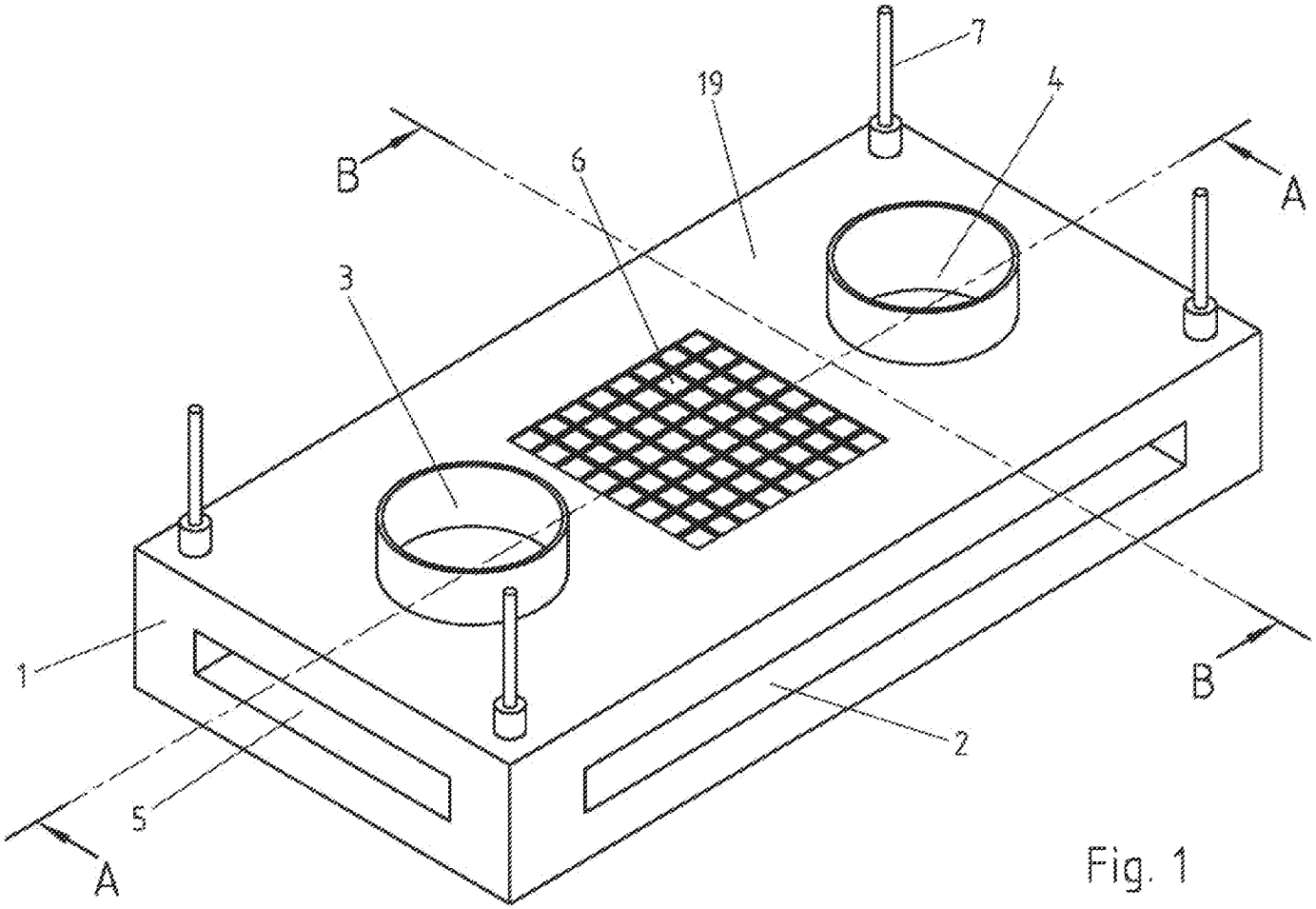
FIG. 1 illustrates an example of a modular island, according to the invention.

As explained previously, the best thermal comfort in a room is achieved when it is possible to diffuse the thermal power necessary to the heating and to the cooling of the room via a combination of radiation and thermal convection.

Moreover, the diffuse convective power can be a source of discomfort (air current) or of inefficiency (layering) if the blown air is not oriented as a function of its temperature. Furthermore, hot air needs to be blown at high velocities so as to benefit sufficiently from kinetic energy to reach the floor of the room, unlike cold air, which is denser than the ambient air, which drops naturally toward the floor of the room and which has to be blown at low velocities so as to avoid air current effects.

Finally, many buildings or premises, such as office spaces, require flexibility allowing modularity of the spaces that are often subject to reorganization via partitioning modifications.

The invention thus described proposes to address all of these constraints through modular islands, working by radiation and thermal convection, that are capable of adapting automatically (therefore without action from the user) the orientation and the velocity of the airstream blown toward the room, the modular island or the set of modular islands occupying only a part of the surface of the ceiling without needing to be attached to the vertical walls.

Although methods and materials that are similar or equivalent to the those described here may be used in practice, appropriate methods and materials are described hereinbelow. All the publications, patent applications, patents and other references mentioned here are incorporated for reference in full. Furthermore, the materials, the methods and the embodiments described are only illustrative and are not intended to be limiting.

In case of conflict, the present description, including the definitions, will prevail.

Unless defined otherwise, all the technical and scientific terms used in the present document have the same meaning as that generally understood by the person skilled in the art to which the subject matter belongs. As used here, the following definitions are supplied in order to facilitate understanding of the present invention.

The term "to comprise or comprises" is generally used in the sense of inclusion, that is to say of allowing the presence of one or more features or components.

As used in the description of the claims, singular forms "a", "an" and "the" include plural references, unless indicated otherwise in the context.

The term "treated air" means air cooled or heated (so as to meet the cooling or heating needs for a room) and provided with an input of external fresh air so as to ensure the hygienic air ventilation of the room.

As a general rule, "cold air" is understood to mean a temperature ranging up to 20° C. and "hot air" any temperature situated above 20° C.

The present invention proposes to provide an automatic ceiling diffuser system for a room, said system being suitable for heating, cooling and ventilating said room by radiation and thermal convection, said system comprising at least one modular island intended to be attached to the ceiling of the room, said modular island comprising:

- a peripheral frame (1) provided with at least one line for attachment of a diffusion element such as a taut fabric (8) situated in its lower part opposite the ceiling; on one of its faces, said peripheral frame (1) comprises a slit (2) for blowing air toward the room;
- a diffusion element such as a taut fabric (8) attached to the attachment line of the peripheral frame, visible from the room and forming a horizontal bottom face of said modular island;
- a cover (19) forming the top face of the modular island facing the ceiling;
- an air blowing connection outlet (4) fixed to the cover (18) of the modular island and allowing the injection of treated air into the internal volume of the modular island;
- a channel of articulated baffles (10, 11) formed by an upper articulated baffle (11) and a lower articulated baffle (10), fixed to the peripheral frame (1) at the air blowing slit (2) and making it possible to orient the blown air at angle defined with respect to the ceiling varying from 0°, namely parallel to the ceiling when cold air is blown into the island, to a maximum of 700 when hot air is blown into the modular island;
- a thermostatic actuation means (13) making it possible to actuate said channel of articulated baffles (10, 11) via an actuation means of the baffles such as an actuation rod (14) and conferring on the channel a blowing angle dependent on the temperature of the treated air injected into the modular island, said thermostatic actuation means (13) comprising a piston, the output stroke of which depends on the temperature of air in which said thermostatic actuation means (13) is immersed;
- a return spring (15) making it possible to exert a force opposite the stroke of the piston of said thermostatic actuation means (13) and thus make it revert to its minimal stroke when cold air is blown into the modular island, and in which
- said channel of articulated baffles (10, 11) comprises an articulated means for maintaining parallelism (12) positioned in said channel and linking the upper and lower articulated baffles (11 and 10) to the articulation points B and C respectively, said upper and lower articulated baffles (11 and 10) fixed to the peripheral frame (1) at the articulation points A and D describing, with the articulation points B and C of said articulated means for maintaining parallelism (12), a parallelogram A-B-C-D imposing parallelism on its opposite sides.

According to one embodiment of the invention, said automatic system is configured so that:

when hot air is blown into the modular island, the section of the channel of articulated baffles (10, 11) formed between the lower (10) and upper (11) articulated baffles decreases when the inclination thereof increases with respect to a horizontal plane generating a greater velocity of blown air favoring the heating mode;

when cold air is blown into the modular island, the section of the channel of articulated baffles (10, 11) formed between the lower (10) and upper (11) articulated baffles increases up to a maximal section of the channel when the two articulated baffles (10, 11) are in horizontal position generating a low air velocity favoring the cooling mode.

Preferably, said modular island is further provided with an acoustic insulation (16) as well as said diffusion element such as a taut fabric (8), optionally micro-perforated, allowing the acoustic treatment of the room.

Advantageously, the automatic ceiling diffuser and acoustic treatment system further comprises an air suction connection outlet (3) fixed to the top cover (19) of the modular island and communicating with a suction box (18) provided with a filter (6) sucking the ambient air from the room from the top cover (19) of said modular island.

Preferably, said air suction connection outlet (3) is connected to an air suction duct so as to route the ambient air from the room to an external air-conditioning unit such as a fan coil unit or an air-handling unit for air to be injected.

Advantageously, the treated air injected into the internal volume of the modular island via the air blowing connection outlet (4) corresponds to the ambient air, heated or cooled and optionally mixed with fresh ventilation air.

According to one embodiment of the invention, said thermostatic actuation means (13) deploys a stroke of its piston that is proportional to the temperature of the treated air injected into the modular island.

According to another embodiment, said actuation means of the baffles (14) linking the thermostatic actuation means (13) to the channel of articulated baffles (10, 11) is fixed to the upper articulated baffle (11) thus subjecting said channel of articulated baffles (10, 11) to an angle dependent on the temperature of treated air injected into the modular island.

Advantageously, the modular island is further provided with at least one light source (17) fixed inside the modular island and allowing lighting of the room, the light generated by the light source (17) being distributed over the diffusion element, such as a taut fabric (8) visible from the room.

According to a preferred embodiment, the modular island is further provided with a light diffusion element such as a taut fabric (9) and a top attachment line for the peripheral frame (1) making it possible to attach the light diffusion element (9) situated below the light source (17).

Advantageously, said lower articulated baffle (10) serves as a barrier to the light in order not to make the light source (17) visible and/or prevent light from exiting through the blowing slit (2).

According to another embodiment, said modular island comprises attachment hangers (7) or another fixing means allowing it to be fixed to the ceiling of the room.

According to a preferred embodiment, said thermostatic actuation means (13) is a cylinder.

According to one embodiment of the invention, provision is made for several modular islands to be attached to one another allowing the treated air to circulate from one modular island to the other via an inter-module connection slit (5) disposed on the small sides (23 and 24) of the peripheral frame (1) of each modular island.

Another object of the invention is to provide a modular island intended for heating, cooling and ventilating a room by radiation and thermal convection, said modular island being able to be suspended from the ceiling of a room, said modular island comprising:

a peripheral frame (1) provided with at least one line for attachment of a diffusion element such as a taut fabric (8) situated in its lower part opposite the ceiling; on one or more of its faces, said peripheral frame (1) comprises a slit (2) for blowing air toward the room;

a diffusion element such as a taut fabric (8), attached to the attachment line of the peripheral frame, visible from the room and forming the horizontal bottom face of said modular island;

a cover (19) forming the top face of the modular island facing the ceiling;

an air blowing connection outlet (4) fixed to the cover (18) of the modular island and allowing the injection of treated air into the internal volume of the modular island;

a channel of articulated baffles (10, 11) formed by an upper articulated baffle (11) and a lower articulated baffle (10), fixed to the peripheral frame (1) at the air blowing slit (2) and making it possible to orient the blown air at an angle defined with respect to the ceiling varying from 0°, namely parallel to the ceiling when cold air is blown into the island, to a maximum of 70° when hot air is blown into the modular island;

a thermostatic actuation means (13) making it possible to actuate said channel of articulated baffles (10, 11) via an actuation means of the baffles such as an actuation rod (14) and conferring on the channel a blowing angle dependent on the temperature of the treated air injected into the modular island, said thermostatic actuation means (13) comprising a piston, the output stroke of which depends on the temperature of air in which said thermostatic actuation means (13) is immersed;

a return spring (15) making it possible to exert a force opposite the stroke of the piston of said thermostatic actuation means (13) and thus make it revert to its minimal stroke when cold air is blown into the modular island, and in which, said channel of articulated baffles (10, 11) comprises an articulated means for maintaining parallelism (12) positioned in said channel and linking the upper and lower articulated baffles (11 and 10) to the articulation points B and C respectively, said upper and lower articulated baffles (11 and 10) fixed to the peripheral frame (1) at the articulation points A and D, with the articulation points B and C of said articulated means for maintaining parallelism (12), a parallelogram A-B-C-D imposing parallelism on its opposite sides.

The invention as described notably includes the advantage of allowing thermal diffusion toward the room being served both by radiation and by convection. Indeed, under the effect of the treated air stream (hot or cold) injected into the modular island, the diffusing surface (8) (ideally a taut fabric) will be heated up or cooled down so as to generate a thermal radiation toward the room. Moreover, the treated air injected into the modular island, after having given off a part of its thermal energy to the diffusing service, emerges through the blowing slit or slits (2) thus resulting in diffusion by thermal convection toward the room (room to be treated).

Moreover, by virtue of the thermostatic actuation means (13) (for example a thermostatic cylinder) on the articulated channel of baffles (10, 11), this solution allows an orientation of the air stream blown through the slit (2) (convective power) dependent on the temperature of the treated air stream, so, when cold air is injected into the modular island (in cooling mode) it will be blown parallel to the ceiling, ideally at 0° (minimal stroke of the thermostatic actuation means (13)); conversely, when hot air is injected into the modular island (in heating mode), it will be blown toward the room (ideally at 45°) so as to eliminate the layering effects.

Finally, the geometry used based on an articulation (ideally generating a parallelogram at the deflectors), allows a variation of the section of the blowing slit (2), so, in cooling mode, the baffles (or fins) in horizontal position generate the maximal section of the slit (2) and therefore low air velocities; conversely, in heating mode, the section of the slit (2) is maximally reduced, thus increasing the velocity of the blown air and therefore the reach of the air stream. The system according to the invention makes it possible to act on the air blowing slit (2) and therefore on the articulated channel of baffles (10, 11) so as to direct its stream and vary its section.

DETAILED DESCRIPTION OF THE FIGURES

Figure 2:
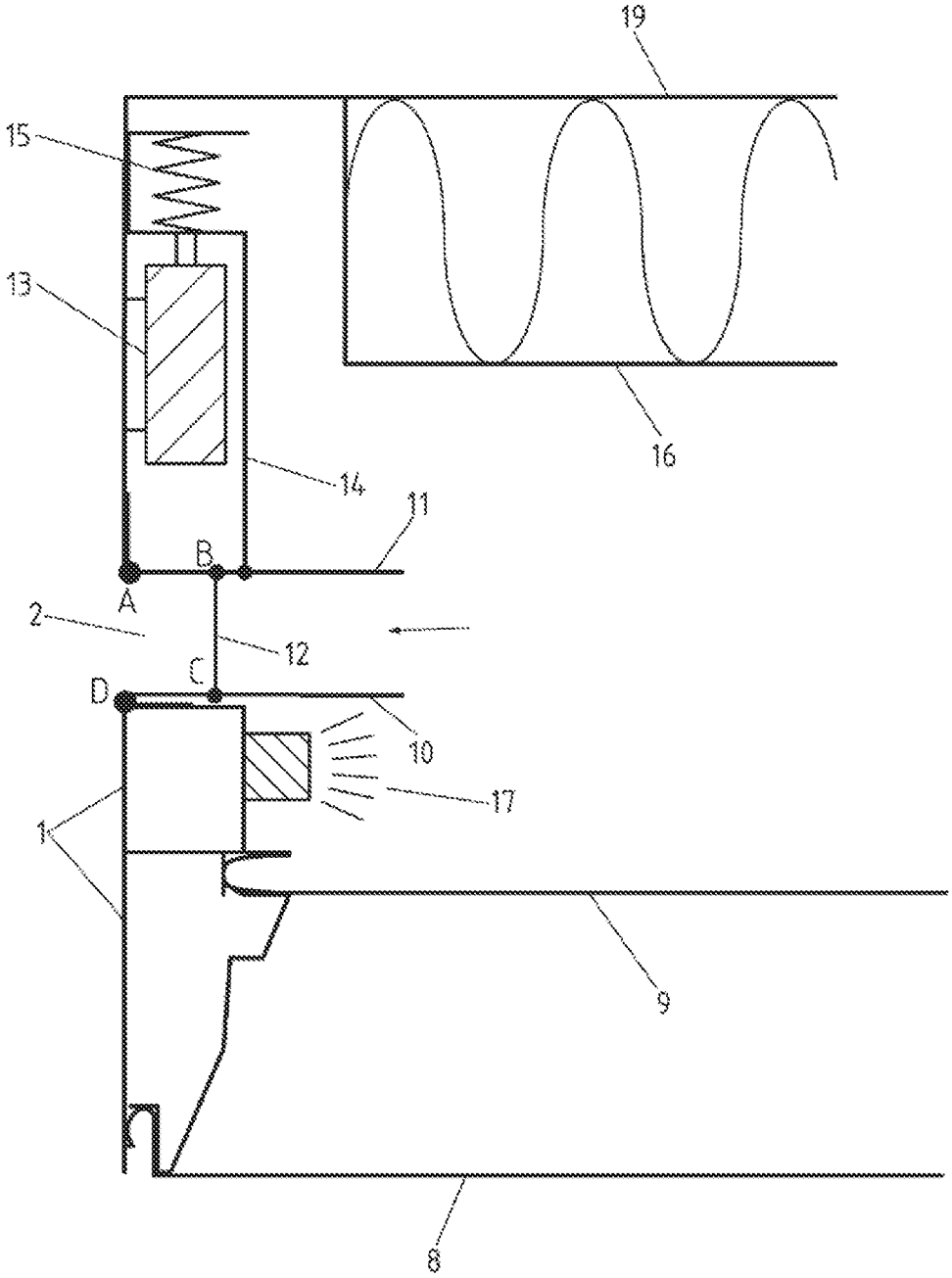
FIG. 2 illustrates a transverse detailed section of a modular island when operating in nominal cooling conditions.
Figure 3:
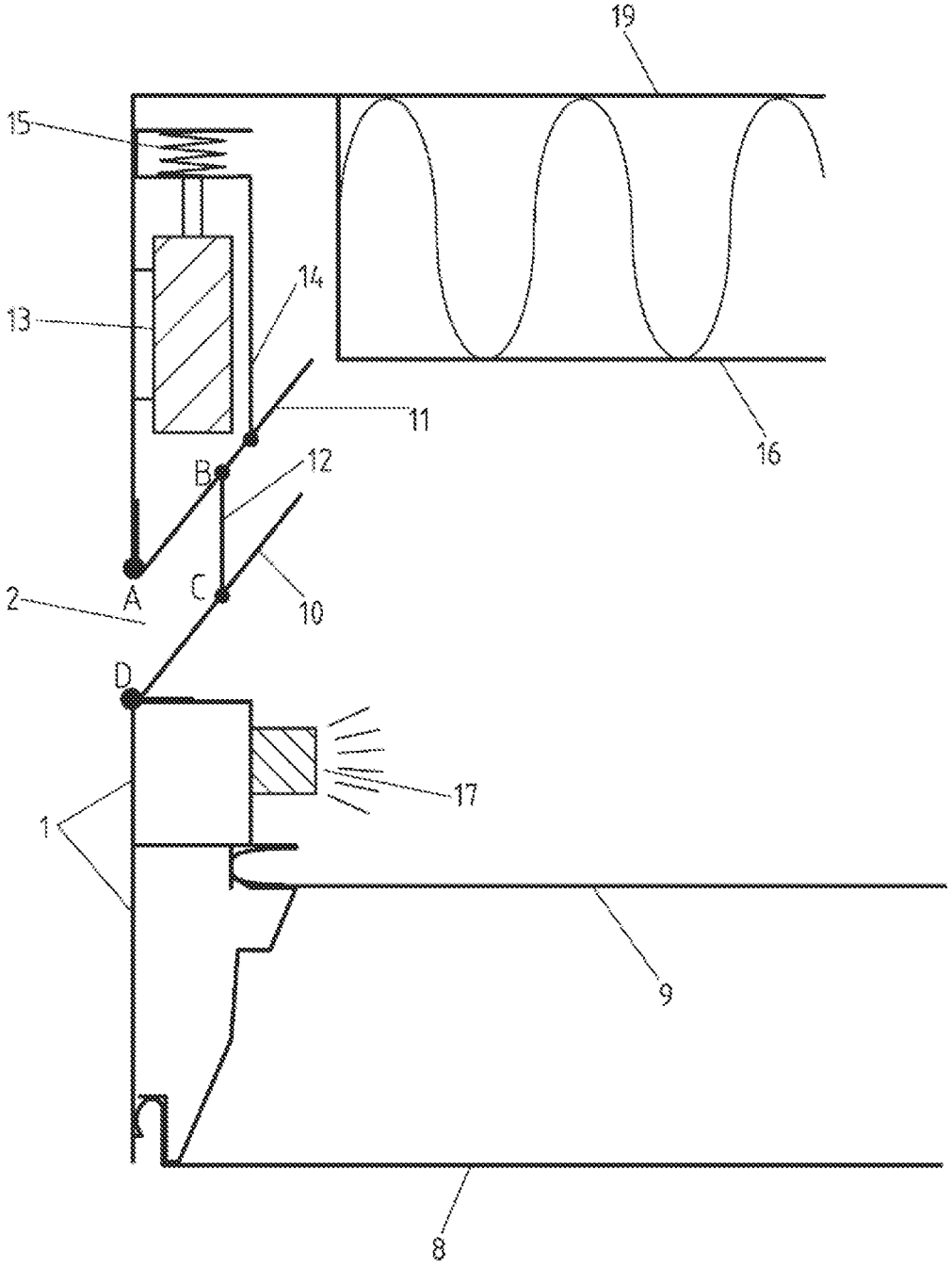
FIG. 3 illustrates a transverse detailed section of a modular island operating in nominal heating conditions.
Figure 4:
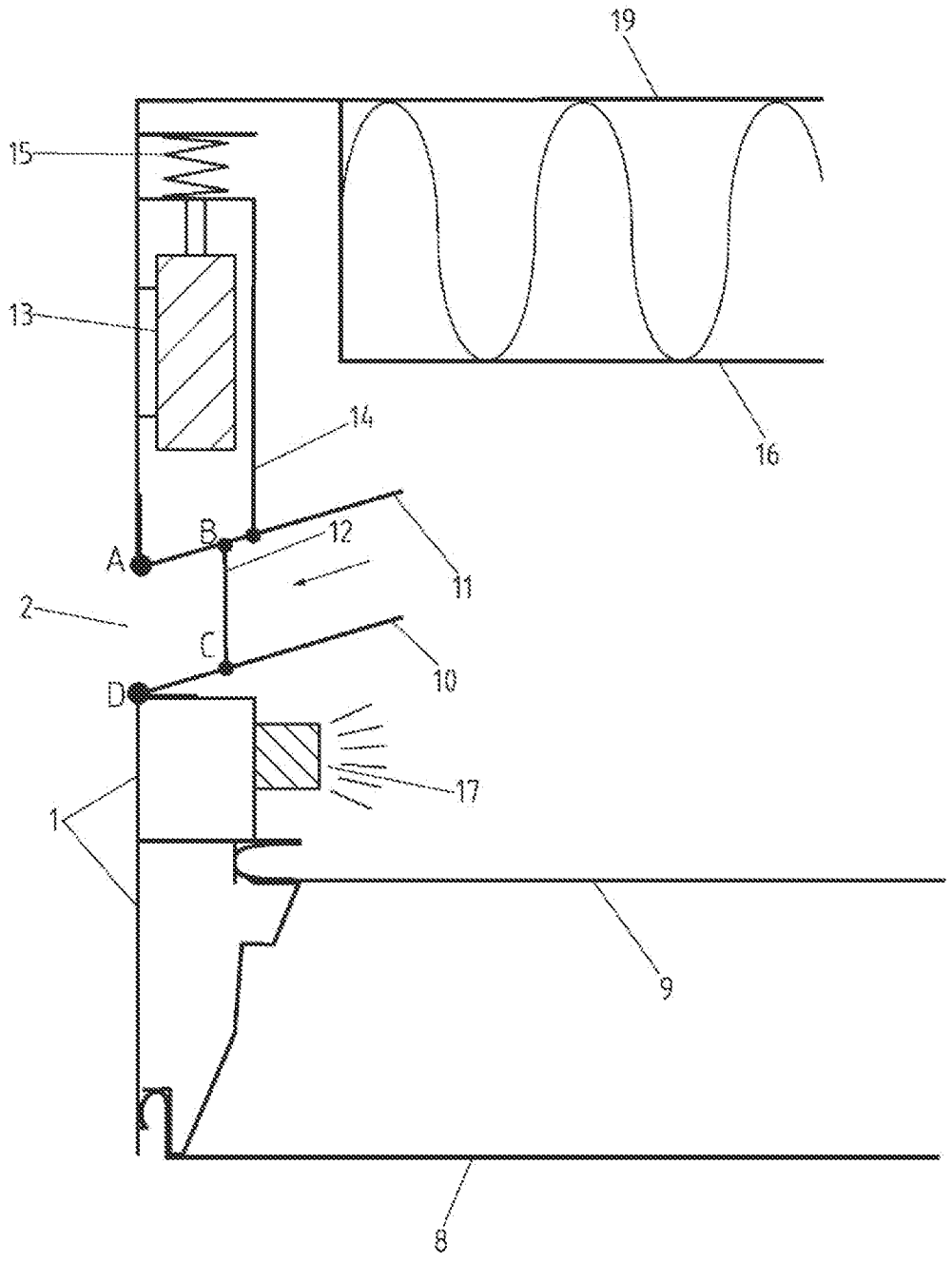
FIG. 4 illustrates a transverse detailed section of a modular island operating in intermediate heating or cooling conditions.
Figure 5:
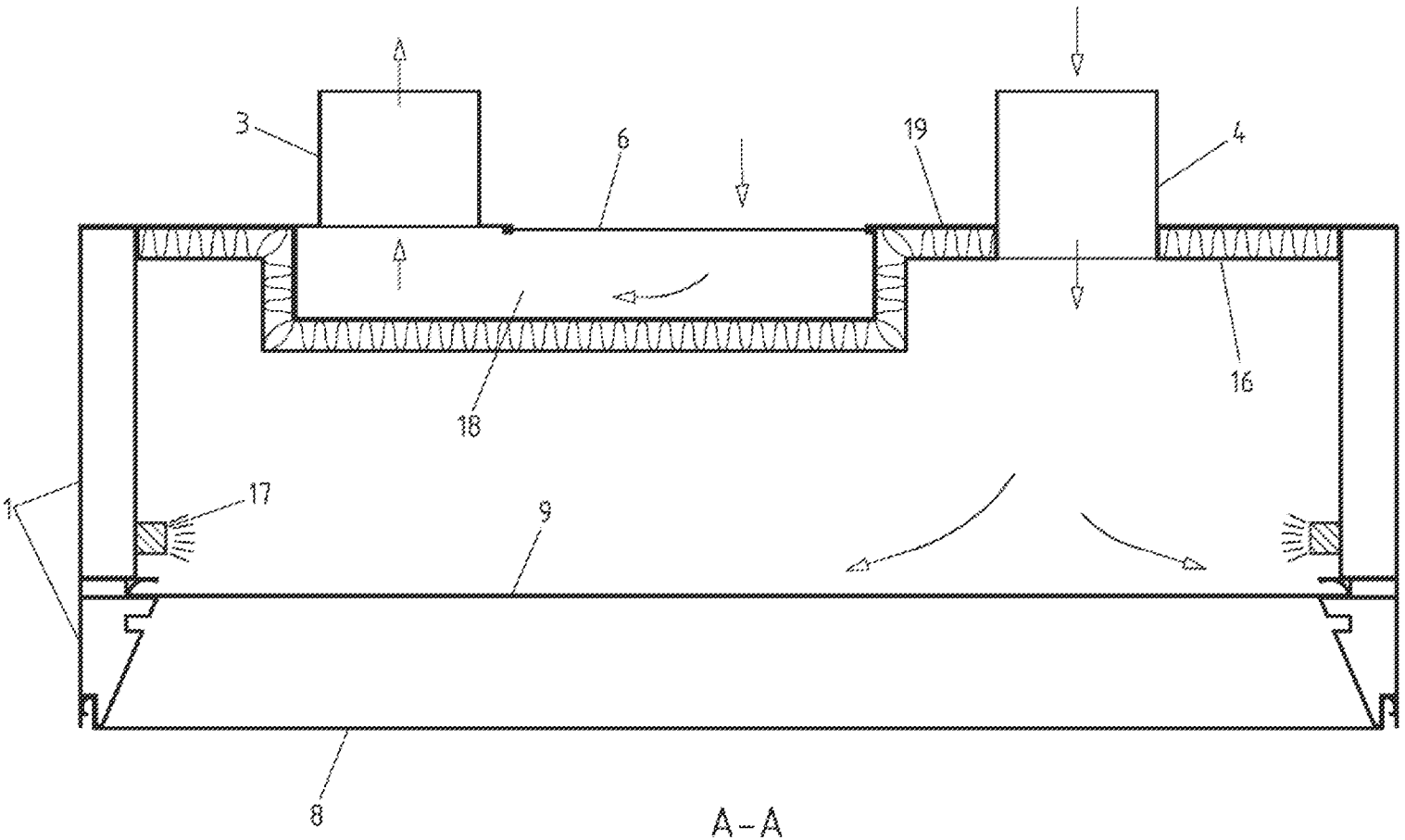
FIG. 5 illustrates a longitudinal section of a modular island.

In particular, FIG. 1 proposes a modular island element for heating and/or cooling and ventilating a room of a building, the modular island element, once suspended from said ceiling via hangers (7) comprises: a connection outlet (3) allowing connection to an air suction duct so as to route the ambient air from the room to an air-conditioning unit, for example a fan coil unit or an air-handling unit;

- the air sucked from the room passing ideally through a filter (6) via, for example, a tight filter-bearing suction box (18) fixed to the top cover (19) of the modular island (see FIG. 5);
- once heated or cooled and optionally mixed with fresh ventilation air (if the modular island is also connected to the ventilation system of the room), the treated air is injected into the volume of the island via a blowing duct connection outlet (4);
- according to the temperature of the treated air injected into the island, the thermostatic cylinder (13) (or any other equipment making it possible to fulfil the same purpose) deploys a stroke of its piston that is proportional to the temperature of the injected air (see FIGS. 2, 3 and 4).

The hotter the air, the greater the stroke, and vice versa, a return spring (15) makes it possible to apply a force opposing the stroke of the thermostatic cylinder (13) so as to return the latter to its minimal stroke when cold air is blown into the island;

- the thermostatic cylinder (13) actuates an actuation means of the air blowing baffles (14), such as, for example, an actuation rod (or rod linkage) connected to the channel of articulated baffles (10, 11) subjecting the baffles (10, 11) to an angle dependent on the temperature of treated air injected into the modular island;
- whatever their angle, the articulated baffles, ideally two baffles with one upper and one lower (10 and 11), fixed to the peripheral frame (1) remain parallel by virtue of the articulated means for maintaining parallelism of the baffles such as, for example, an articulated rod (12) linking them to one another, and in fact the articulation points between the baffles (ideally two baffles 10 and 11), the peripheral frame (1) and the articulated means for maintaining parallelism of the baffles (12) ideally describe a parallelism A-B-C-D (see FIGS. 2, 3 and 4);
- the treated air, injected into the modular island, is thus blown toward the room, via the blowing slit (2) at an angle equivalent to that of the baffles which are themselves actuated by the thermostatic cylinder (13) and is therefore adapted automatically so as to observe the inclination that makes it possible to achieve the best thermal comfort;
- through the characteristics of the geometry adopted by the baffles (ideally a parallelogram A-B-C-D), the air passage section between the baffles (ideally a lower baffle (10) and an upper baffle (11)) decreases when the inclination thereof increases with respect to a horizontal plane, so, upon an injection of very cold air (FIG. 2), the section of the slit is maximal (the baffles being ideally in horizontal position) thus generating a low air velocity favorable to comfort in cooling mode. Conversely, when very hot air is blown into the island (FIG. 3) the section of the slit is minimal, thus generating a greater blown air velocity favorable to the heating mode.

The invention thus described makes it possible to vary both the angle at which the treated air is blown toward the room and the velocity at which the latter is blown, and do so automatically as a function of the temperature of the air injected into the modular island.

Advantageously, the modular island is provided with an acoustic insulation (16) and a micro-perforated diffusion element (8) (for example a taut fabric), thus allowing the acoustic treatment of the room.

Preferably, the island is also provided with a light diffusion element (ideally a taut fabric) (9) and a light source (17) fixed for example to its periphery or onto the bottom face of the cover (19) or of the insulation (16) allowing the lighting of the room via a light distributed over the diffusion element (8) (ideally a taut fabric) visible from the room.

Advantageously, the lower articulated baffle (11) serves as a barrier to the light so as to prohibit light from exiting through the blowing slit (2).

According to a particular embodiment, the modular island described previously does not include an air suction outlet, box and filtering device so as to generate only a blowing of air toward the room. In this case, the suction of air is performed via a device independent of the present invention.

According to a particular embodiment of the invention, several modular islands can be associated so as to generate a greater emitting surface. In this case, a connection slit (5) disposed, for example, on the small sides of each modular island, allows the treated air, blown into the islands, to circulate from one modular island to the other. These connection slits (5) can of course also be situated on the large sides of the modular island, and in this case the blowing slits toward the room (2) would be situated on the small sides.

For this, the connection slits of each modular island are connected to one another, ideally by attaching the islands to one another on the side of the face including the inter-module connection slit (5).

Figure 6:
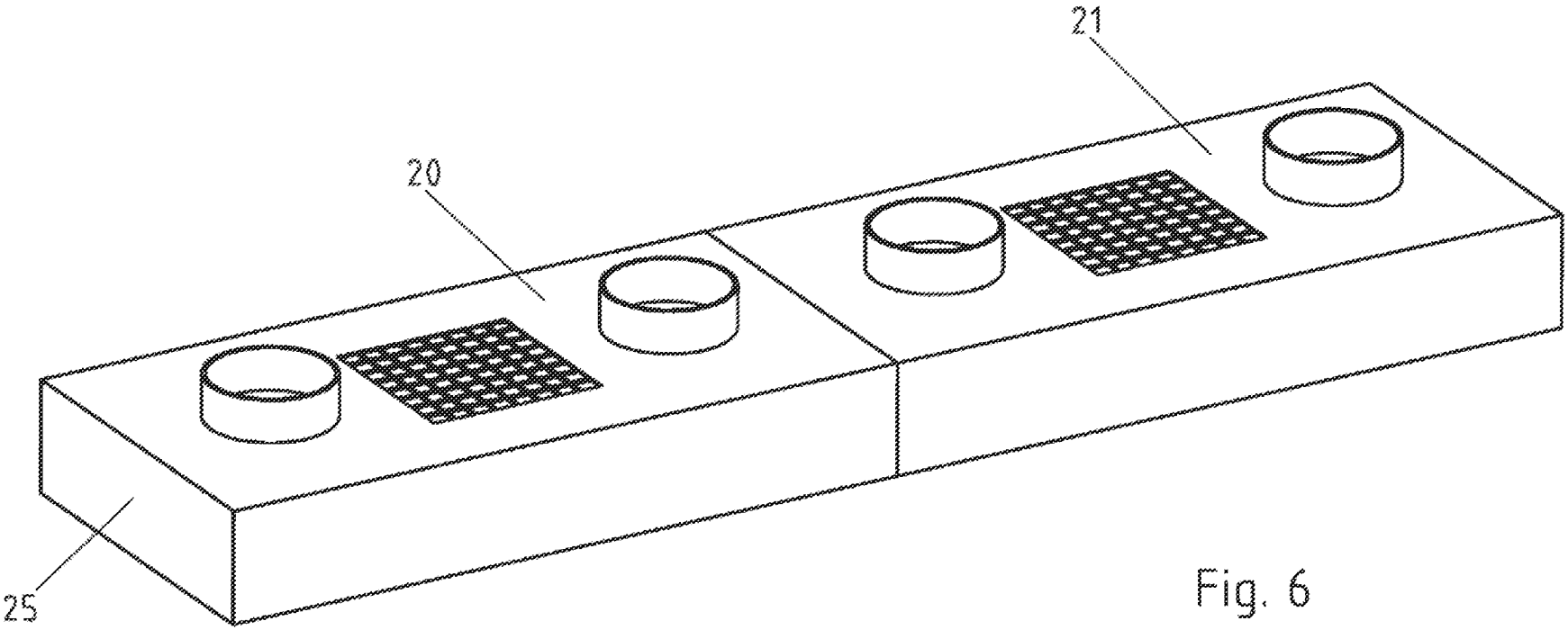
FIG. 6 illustrates a perspective view of two modular islands attached to one another.
Figure 7:
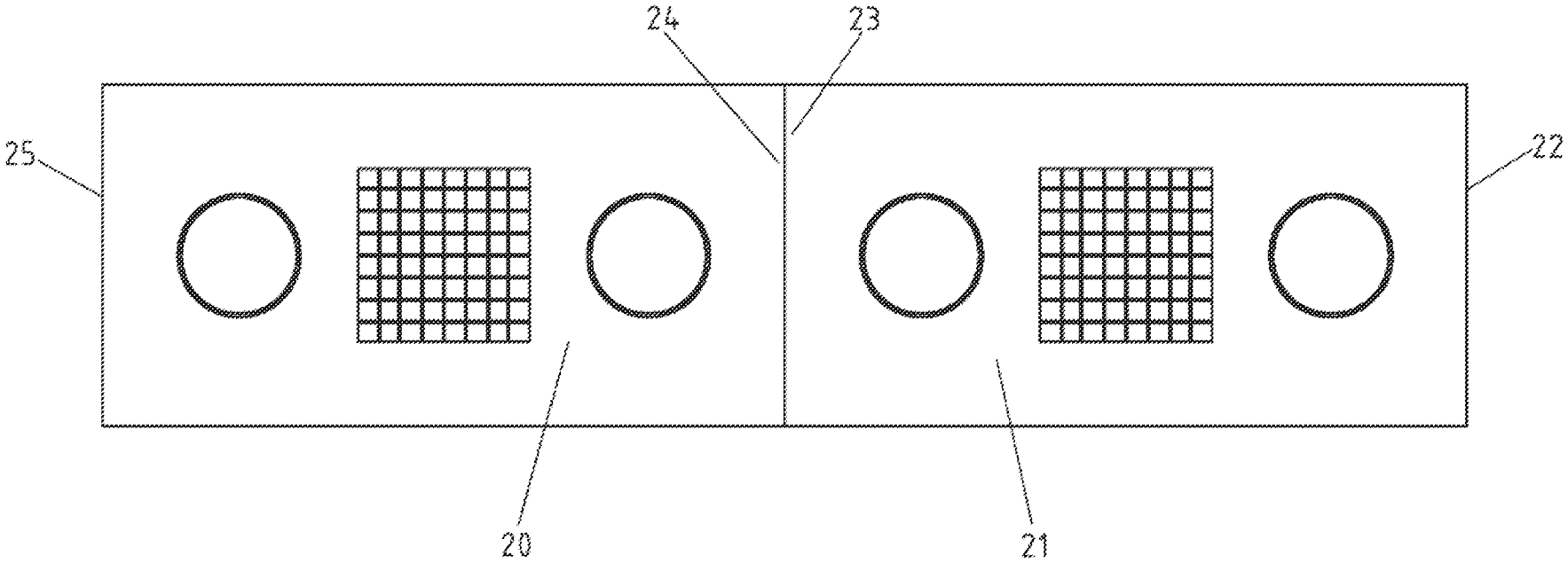
FIG. 7 illustrates a top view of two modular islands attached to one another.

When several modular islands are attached (see FIGS. 6 and 7), for example two modular islands (20 and 21) their small common sides (23 and 24) are provided with a connection slit (5) allowing the passage of treated air from one modular island to the other.

The small sides situated at the ends of the structure obtained (22 and 25) then either have no connection slit (5), or their connection slit (5) is blocked by any means suited to this purpose.

Obviously, according to another embodiment of the invention, provision is also made to attach more than two modular islands to one another, for example three or four, or more. In this case, the small sides situated at the ends of the structure obtained (22 and 25) do not have a connection slit (5) either.

By contrast, a modular island used on its own, therefore not attached to other modular islands, will have no connection slit (5) on these small sides or will have the connection slits of its small sides blocked by any means that makes it possible to fulfil this purpose.

REFERENCE NUMBERS EMPLOYED IN THE FIGURES

1: peripheral frame of the modular island
2: blowing slits toward the room
3: air suction duct connection outlet
4: air blowing duct connection outlet
5: inter-module connection slit
6: filter
7: hanger for attaching the modular island
8: diffusion element such as, for example, a taut finishing fabric visible from the room
9: light diffusion element, for example a taut fabric allowing uniform diffusion of light in case of the incorporation of LEDs
10: lower air blowing articulated baffle
11: upper air blowing articulated baffle
12: articulated means for maintaining parallelism of the baffles, such as, for example, an articulated rod
13: thermostatic actuation means, such as, for example, a thermostatic cylinder
14: actuation means of the air blowing baffles, such as, for example, an actuation rod
15: return spring
16: acoustic insulation
17: LED light source
18: suction box with filter-holding slideway
19: top cover of the modular island
20: modular island 1 of a composition of attached modular islands
21: modular island 2 of a composition of attached modular islands
22: right small side, modular island 1
23: left small side, modular island 1
24: right small side, modular island 2
25: left small side, modular island 2

The invention claimed is:

1. An automatic ceiling diffuser system of a room, the system being suitable for heating, cooling and ventilating the room by radiation and thermal convection, the system comprising at least one modular island configured to be attached to the ceiling of the room, the modular island comprising:

a peripheral frame provided with at least one line attachment of a diffuser element wherein the diffuser element is a taut fabric and a lower part of the diffuser element is disposed opposite the ceiling; wherein on one or more of its faces, the peripheral frame comprises a slit for blowing air toward the room;

the diffuser element, attached to the attachment line of the peripheral frame, visible from the room and forming a horizontal bottom face of the modular island;

a top cover forming a top face of the modular island facing the ceiling;

an air blowing connection outlet fixed to a suction box of the modular island and configured to allow an injection of treated air into an internal volume of the modular island;

a channel of articulated baffles formed by an upper articulated baffle and a lower articulated baffle, fixed to the peripheral frame at the air blowing slit and the channel of articulated baffles are configured to orient the blown air at an angle defined with respect to the ceiling varying from 0°, and parallel to the ceiling when cold air is blown into the island, to a maximum of 70° when hot air is blown into the modular island;

a thermostatic actuation means configured to actuate the channel of articulated baffles via a baffle actuation rod and conferring on the channel a blowing angle dependent on a temperature of the treated air injected into the modular island the thermostatic actuation means comprising a piston, tan outlet stroke of which depends on the temperature of air in which the thermostatic actuation means is immersed; and a return spring configured to exert a force opposite the outlet stroke of the piston of the thermostatic actuation means and thus make it revert to its minimal stroke when cold air is blown into the modular island, and the channel of articulated baffles comprises an articulated means for maintaining parallelism positioned in the channel and linking the upper and lower articulated baffles to articulation points B and C respectively, the upper and lower articulated baffles fixed to the peripheral frame at articulation points A and D describing, with the articulation points B and C of the articulated means for maintaining parallelism, a parallelogram A-B-C-D imposing a parallelism on its opposite faces, wherein the modular island further comprises an air suction connection outlet fixed to the top cover of the modular island and configured to communicate with a suction box provided with a filter configured to suck ambient air from the room from the top cover of the modular island.

2. The automatic system as claimed in claim 1, wherein the automatic system is configured so that:

when hot air is blown into the modular island, a section of the channel of articulated baffles formed between the lower and upper articulated baffles decreases when inclination thereof increases with respect to a horizontal plane generating a greater blown air velocity favoring a heating mode; and when cold air is blown into the modular island, the section of the channel of articulated baffles formed between the lower and upper articulated baffles increases up to a maximum section of the channel when two of the articulated baffles are in a horizontal position generating a low air velocity favoring a cooling mode.

3. The automatic system as claimed in claim 1, wherein the modular island is further provided with an acoustic insulation as well as the diffuser element, optionally micro-perforated, allowing acoustic treatment of the room.

4. The automatic system as claimed in claim 1, wherein the air suction connection outlet is connected to an air suction duct so as to route ambient air from the room to an external air-conditioning unit wherein the air-conditioning unit is a fan coil or an air-handling unit for treating air to be injected.

5. The automatic system as claimed in claim 4, wherein the treated air injected into the internal volume of the modular island via the air blowing connection outlet corresponds to the air heated or cooled and optionally mixed with fresh ventilation air input by the external air-conditioning unit wherein the air-conditioning unit is a fan coil or an air-handling unit for treating air to be injected.

6. The automatic system as claimed in claim 1, wherein the thermostatic actuation means configured to deploy a stroke of its piston that is proportional to the temperature of the treated air injected into the modular island.

7. The automatic system as claimed in claim 1, wherein the actuation means of the baffles linking the thermostatic actuation means to the channel of articulated baffles is fixed to the upper articulated baffle thus subjecting the channel of articulated baffles to an angle dependent on the temperature of treated air injected into the modular island.

8. The automatic system as claimed in claim 1, wherein the modular island is further provided with at least one light source fixed inside the modular island and allowing illumination of the room, the light generated by the light source being distributed over the diffuser element, and is visible from the room.

9. The automatic system as claimed in claim 8, wherein the modular island is further provided with a light diffusion element wherein the light diffusion element is a taut fabric, and an upper attachment line for the peripheral frame configured to attach the light diffusion element below a level of the light source.

10. The automatic system as claimed in claim 8, wherein the lower articulated baffle serves as a barrier to the light so as not to make the light source visible and/or prevent light from exiting through the blowing slit.

11. The automatic system as claimed in claim 1, wherein the modular island comprises attachment hangers or another fixing means configured to allow it to be fixed to the ceiling of the room.

12. The automatic system as claimed in claim 1, wherein the thermostatic actuation means is a cylinder.

13. The automatic system as claimed in claim 1, wherein several modular islands are attached to one another allowing the treated air to circulate from one modular island to the other by means of an inter-module connection slit disposed on a small side of the peripheral frame of each modular island.

14. A modular island intended for heating, cooling and ventilating a room by radiation and thermal convection, the modular island configured to be suspended from a ceiling of a room, the modular island comprising:

a peripheral frame provided with at least one line for attachment of a diffusion element wherein the diffusion element is a taut fabric and a lower part of the diffusion element is disposed opposite the ceiling; wherein on or more of its faces, the peripheral frame comprises a slit for blowing air toward the room;

a diffusion element, attached to the line for attaching the peripheral frame, visible from the room and forming a horizontal bottom face of the modular island;

a top cover forming a top face of the modular island facing the ceiling;

an air blowing connection outlet fixed to a suction box of the modular island and configured to allow an injection of treated air into an internal volume of the modular island;

a channel of articulated baffles formed by an upper articulated baffle and a lower articulated baffle, fixed to the peripheral frame at the air blowing slit and the channel of articulated baffles are configured to orient the blown air at an angle defined with respect to the ceiling varying from 0°, parallel to the ceiling when cold air is blown into the island, to a maximum of 70° when hot air is blown into the modular island;

a thermostatic actuation means configured to actuate the channel of articulated baffles via an actuation rod of the baffles and conferring on the channel a blowing angle dependent on a temperature of the treated air injected into the modular island, the thermostatic actuation means comprising a piston, an output stroke of which depends on the temperature of air in which the thermostatic actuation means is immersed; and a return spring configured to exert a force opposite the output stroke of the piston of the thermostatic actuation means and thus make it revert to its minimal stroke when cold air is blown into the modular island, and in which the channel of articulated baffles comprises an articulated means for maintaining parallelism positioned in the channel and linking the upper and lower articulated baffles to articulation points B and C respectively, the upper and lower articulated baffles fixed to the peripheral frame at articulation points A and D describing, with the articulation points B and C of the articulated means for maintaining parallelism, a parallelogram A-B-C-D imposing a parallelism on its opposite sides, wherein the modular island further comprises an air suction connection outlet fixed to the top cover of the modular island and configured to communicate with a suction box provided with a filter configured to suck ambient air from the room from the top cover of the modular island.

* * * * *